US010179693B2

(12) United States Patent
Bankowski

(10) Patent No.: US 10,179,693 B2
(45) Date of Patent: Jan. 15, 2019

(54) PRODUCE BOX

(71) Applicant: Visy R & D Pty Ltd., Victoria (AU)

(72) Inventor: Piotr Bankowski, Victoria (AU)

(73) Assignee: Visy R & D Pty Ltd, Melbourne, Victoria (AU)

( * ) Notice: Subject to any disclaimer, the term of this patent is extended or adjusted under 35 U.S.C. 154(b) by 365 days.

(21) Appl. No.: 14/647,321

(22) PCT Filed: Nov. 27, 2013

(86) PCT No.: PCT/AU2013/001377
§ 371 (c)(1),
(2) Date: May 26, 2015

(87) PCT Pub. No.: WO2014/085845
PCT Pub. Date: Jun. 12, 2014

(65) Prior Publication Data

US 2015/0321832 A1 Nov. 12, 2015

(30) Foreign Application Priority Data

Dec. 3, 2012 (AU) ..... 2012905241

(51) Int. Cl.
*B65D 85/34* (2006.01)
*B65D 5/42* (2006.01)
*B65D 5/68* (2006.01)

(52) U.S. Cl.
CPC ..... *B65D 85/345* (2013.01); *B65D 5/4266* (2013.01); *B65D 5/4295* (2013.01); *B65D 5/68* (2013.01); *B65D 85/34* (2013.01)

(58) Field of Classification Search
CPC ..... B65D 85/34; B65D 85/345; B65D 5/68; B65D 5/4266; B65D 5/4295
(Continued)

(56) References Cited

U.S. PATENT DOCUMENTS 2,615,613 A * 10/1952 Reeser ..... B65D 5/4208 229/117.12
2,835,432 A * 5/1958 Wilmot ..... B65D 5/0281 229/117.16
(Continued)

FOREIGN PATENT DOCUMENTS

| | | | |
|---|---|---|---|
| JP | 2003-128153 | A | 5/2003 |
| WO | 00/46110 | A1 | 8/2000 |
| WO | 2011/081636 | A1 | 7/2011 |

OTHER PUBLICATIONS

International Search Report for Application No. PCT/AU2013/001377, dated Jan. 31, 2014 (4 pages).
(Continued)

*Primary Examiner* — Luan K Bui
(74) *Attorney, Agent, or Firm* — George W Neuner

(57) ABSTRACT

A produce box for storing produce, including a base, including a series of side wall sections coupled together to form a parallelogram; a bottom end section coupled to the wall sections; pairs of face vents located in spaced apart lateral sections of respective ones of said side wall sections; and pairs of major score vents located centrally on respective top and bottom scores of each side wall section of a first opposed pair of said side wall sections. The produce box also includes a lid, including a series of side wall sections coupled together to form a parallelogram; a top end section coupled to the wall sections; pairs of face vents located in spaced apart lateral sections of respective ones of said side wall sections; and pairs of major score vents located centrally on respective top and bottom scores of each side wall section of a first opposed pair of said side wall sections. The pairs of face vents of the base at least partially overlap with corresponding pairs of face vents of the lid so that air can flow therethrough. Further, pairs of major score vents of the base
(Continued)

at least partially overlap with major score vents of the lid so that air can flow therethrough.

29 Claims, 17 Drawing Sheets

(58) Field of Classification Search
USPC ..... 206/521.1; 229/120, 125.19, 916
See application file for complete search history.

(56) References Cited

U.S. PATENT DOCUMENTS 3,018,940 A * 1/1962 Deline ..... B65D 5/22 229/117.16
4,105,152 A * 8/1978 Elward ..... B65D 5/2047 229/112
4,127,228 A * 11/1978 Hall ..... B65D 5/2047 206/205
4,184,625 A * 1/1980 Stollberg ..... B65D 5/5035 206/521.1
4,565,316 A * 1/1986 Jes ..... B65D 5/327 206/521.1
5,121,877 A 6/1992 Bodary et al.
5,690,275 A * 11/1997 Bose ..... B65D 5/4295 220/676
2004/0211824 A1 10/2004 Conway
2005/0051450 A1* 3/2005 Sanabria ..... B65D 5/4295 206/503
2013/0302489 A1* 11/2013 Marlin, Jr. ..... B65D 5/4295 426/419

OTHER PUBLICATIONS

Japanese Office Action dated Jul. 18, 2017,for Application No. JP 2015-544272 (9 pages).

* cited by examiner

PRODUCE BOX

TECHNICAL FIELD OF THE INVENTION

The present invention relates to a produce box.

BACKGROUND OF THE INVENTION

Produce, such as fruit, is typically cooled after harvesting to maintain the quality of the harvested products throughout the supply chain. By maintaining a low produce temperature, deterioration in produce quality is reduced. This is particularly the case in situations where the produce needs to be transported for a long period.

The initial hours after harvesting are extremely important with respect to reducing product temperature. This is especially the case where products have a high respiration rate, as this significantly reduces deterioration of the products. Respiration is the process by which plants, for example, take in oxygen and give out carbon dioxide. Many producers have a stringent postharvest regime to maintain the produce at the highest possible standard. One such technique is post harvest pre-cooling. Pre-cooling is generally carried out in cool rooms using forced-air or static air cooling techniques.

Forced air pre-cooling reduces produce temperature by passing air over or through packaging of freestanding containers or palletised containers. In a typical forced air pre-cooling process, the following steps are performed:

a. two rows of pallets are positioned with a divide between them;
b. a heavy duty tarpaulin is pulled across the top and down front of the divide;
c. a fan at the opposite end of the divide draws air from the cool room, through the palletised containers, down the divide and discharges back into the cool room.

Static cooling is carried out by placing palletised products in cartons directly in cool rooms and relying on natural air currents in the cool room, as well as conduction through the cartons, to reduce the produce temperature. Static air cooling is significantly slower than forced air cooling.

Much research has been carried out trying to understand the factors affecting cooling operations and cooling times. Research has previously been undertaken in the following areas with a view to improving cooling operations and cooling times:

a. the heat transfer characteristics of produce, such as fruit and vegetables;
b. air flow rates and volumes; and
c. vent patterns.

Container design has a significant effect on the cooling rate of products for both types of cooling methods. However, optimisation of box vent design and stacking strength may not have previously been systematically investigated. Rather, it was generally understood in the art that produce boxes should be constructed having:

a. 6% to 8% open vent area; and
b. well distributed vents located away from the corners.

An example of a box 1 with such a design is shown in FIGS. 1*a* to 3*c*. It was commonly thought that vents located near the corners of the box significantly reduce the stacking strength.

There are many box designs available on the market for transportation of fresh produce, some with vents and others without, depending on the application requirements. Vented boxes are generally over engineered to compensate for strength loss as a result of including a plurality of vents. The vents have traditionally been placed by designers in similar positions regardless of box manufacturer, as this was thought to be an optimal configuration.

Traditional positioning of vents on a vented produce box includes:

a. on box scores (half on top face, half on side and similar for bottom/side);
b. a short distance from the corner; and
c. equally spaced across the centre of sides.

These designs have been available for several decades with little to no change.

Boxes have previously been designed by focusing on understanding fundamental principles of heat transfer and cooling of produce. Several research groups have purpose built equipment for experimenting with variables and understanding heat transfer. However, this equipment has not been used to design more efficient boxes. A major hurdle to further progress in box design is lack of cooling information when designs are changed. Hence, designs tend to be conservative and obvious with intuition being used as the measure of cooling performance.

It is generally desirable to find a design for a box which has an optimal ventilation system whist reducing the impact on stacking strength.

It is generally desirable to overcome or ameliorate one or more of the above mentioned difficulties, or at least provide a useful alternative.

SUMMARY OF THE INVENTION

In accordance with the invention, there is provided a produce box for storing produce, including:

(a) a base, including:
  (i) a series of side wall sections coupled together to form a parallelogram;
  (ii) a bottom end section coupled to the wall sections;
  (iii) pairs of face vents located in spaced apart lateral sections of respective ones of said side wall sections; and
  (iv) pairs of major score vents located centrally on respective top and bottom scores of each side wall section of a first opposed pair of said side wall sections, and
(b) a lid, including:
  (i) a series of side wall sections coupled together to form a parallelogram;
  (ii) a top end section coupled to the wall sections;
  (iii) pairs of face vents located in spaced apart lateral sections of respective ones of said side wall sections; and
  (iv) pairs of major score vents located centrally on respective top and bottom scores of each side wall section of a first opposed pair of said side wall sections,
  wherein the pairs of face vents of the base at least partially overlap with corresponding pairs of face vents of the lid so that air can flow therethrough, and
  wherein pairs of major score vents of the base at least partially overlap with major score vents of the lid so that air can flow therethrough.

Preferably, the base includes two pairs of spaced apart minor score vents respectively located on top and bottom scores of each side wall section of a second opposed pair of side wall sections, and the lid includes two pairs of spaced apart minor score vents respectively located on top and bottom scores of each side wall section of a second opposed pair of side wall sections.

Preferably, the pairs of minor score vents of the base at least partially overlap with corresponding pairs of minor score vents of the lid so that air can flow therethrough.

In accordance with the invention, there is also provided a base of a produce box for storing produce, including:

(a) a series of side wall sections coupled together to form a parallelogram;

(b) a bottom end section coupled to the wall sections;

(c) pairs of face vents located in spaced apart lateral sections of respective ones of said side wall sections; and (d) pairs of major score vents located centrally on respective top and bottom scores of each side wall section of a first opposed pair of said side wall sections.

Preferably, the base includes two pairs of spaced apart minor score vents respectively located on top and bottom scores of each side wall section of a second opposed pair of side wall sections.

In accordance with the invention, there is also provided a blank for a base of the above described produce box.

In accordance with the invention, there is also provided a blank for the lid of the above described produce box.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
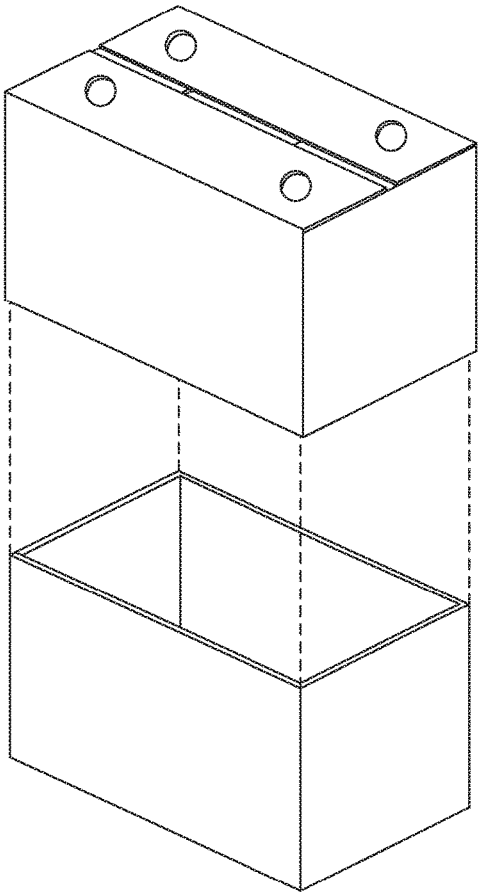
Figure 1 (Prior art)
FIG. 1 is an exploded view of a prior art box.
Figure 2A:
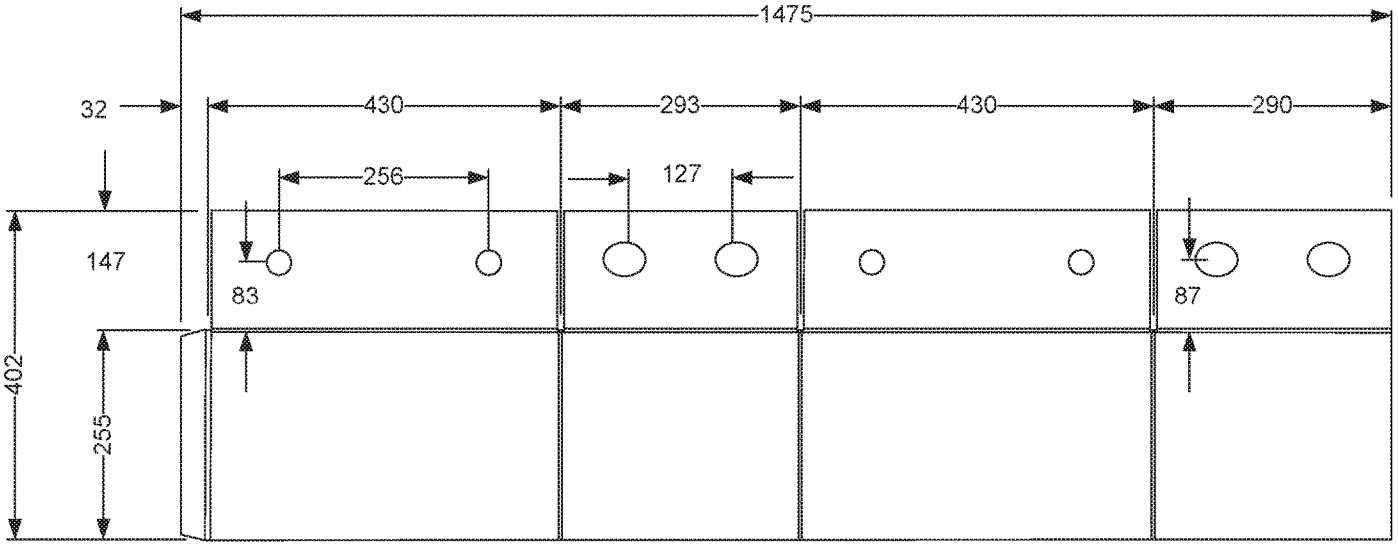
Figure 2a (Prior art)
FIG. 2A is a plan view of a blank for a lid of the box show in FIG. 1.
Figure 2B:
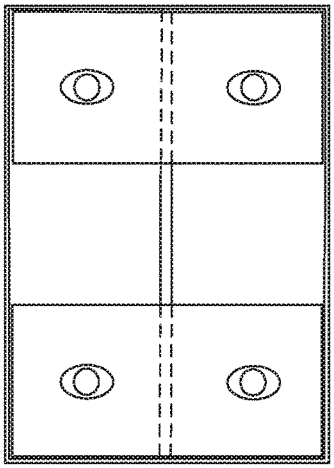
Figure 2b (Prior art)
FIGS. 2B and 2C are bottom and top views of the lid of the box shown in FIG. 1.
Figure 2C:
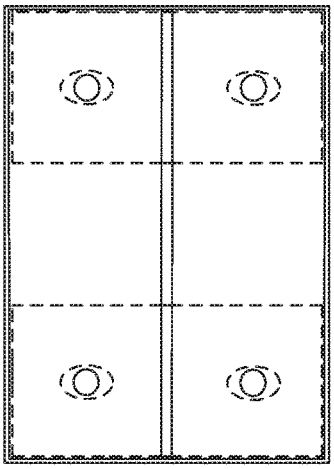
Figure 2c (Prior art)
Figure 3A:
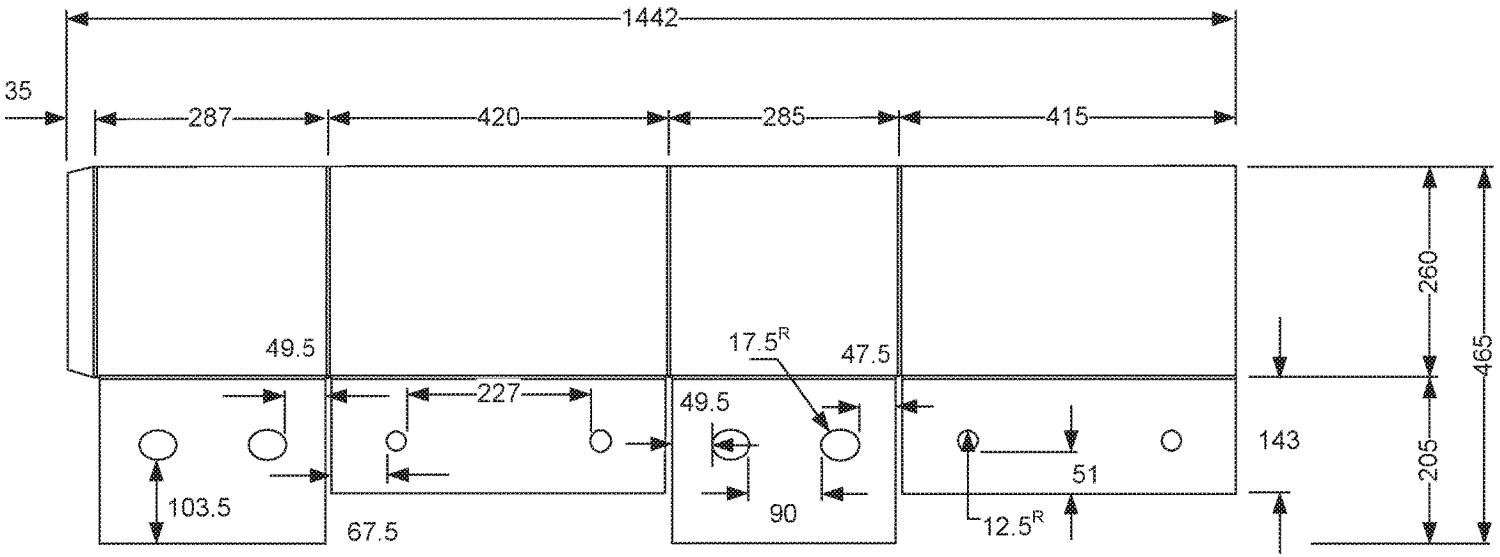
Figure 3a (Prior art)
FIG. 3A is a plan view of a blank for a base of the box show in FIG. 1.
Figure 3B:
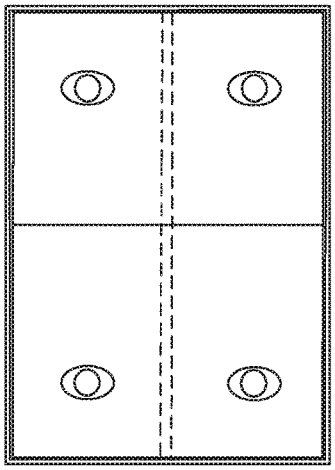
Figure 3b (Prior art)
FIGS. 3B and 3C are bottom and top views of the base of the box shown in FIG. 1.
Figure 3C:
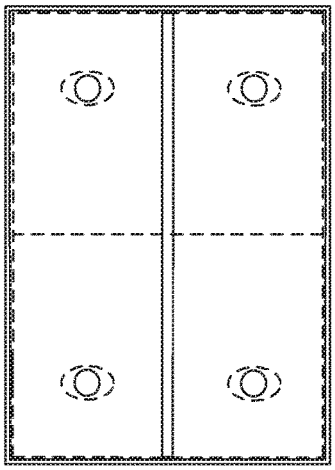
Figure 3c (Prior art)
Figure 4A:
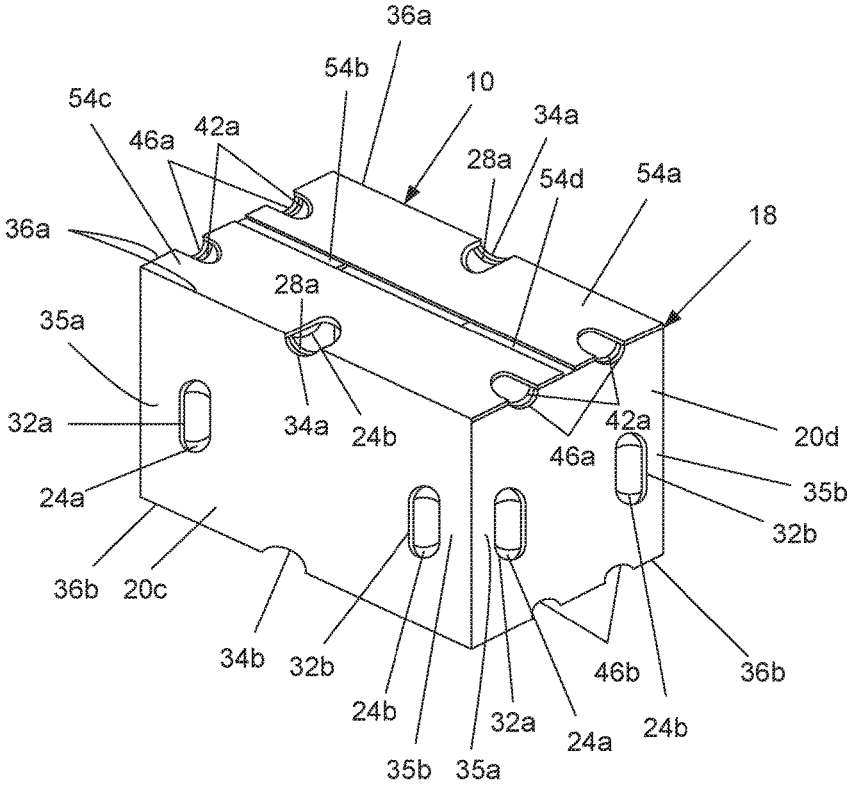
FIG. 4A is a perspective view of a box for storing produce.
Figure 4B:
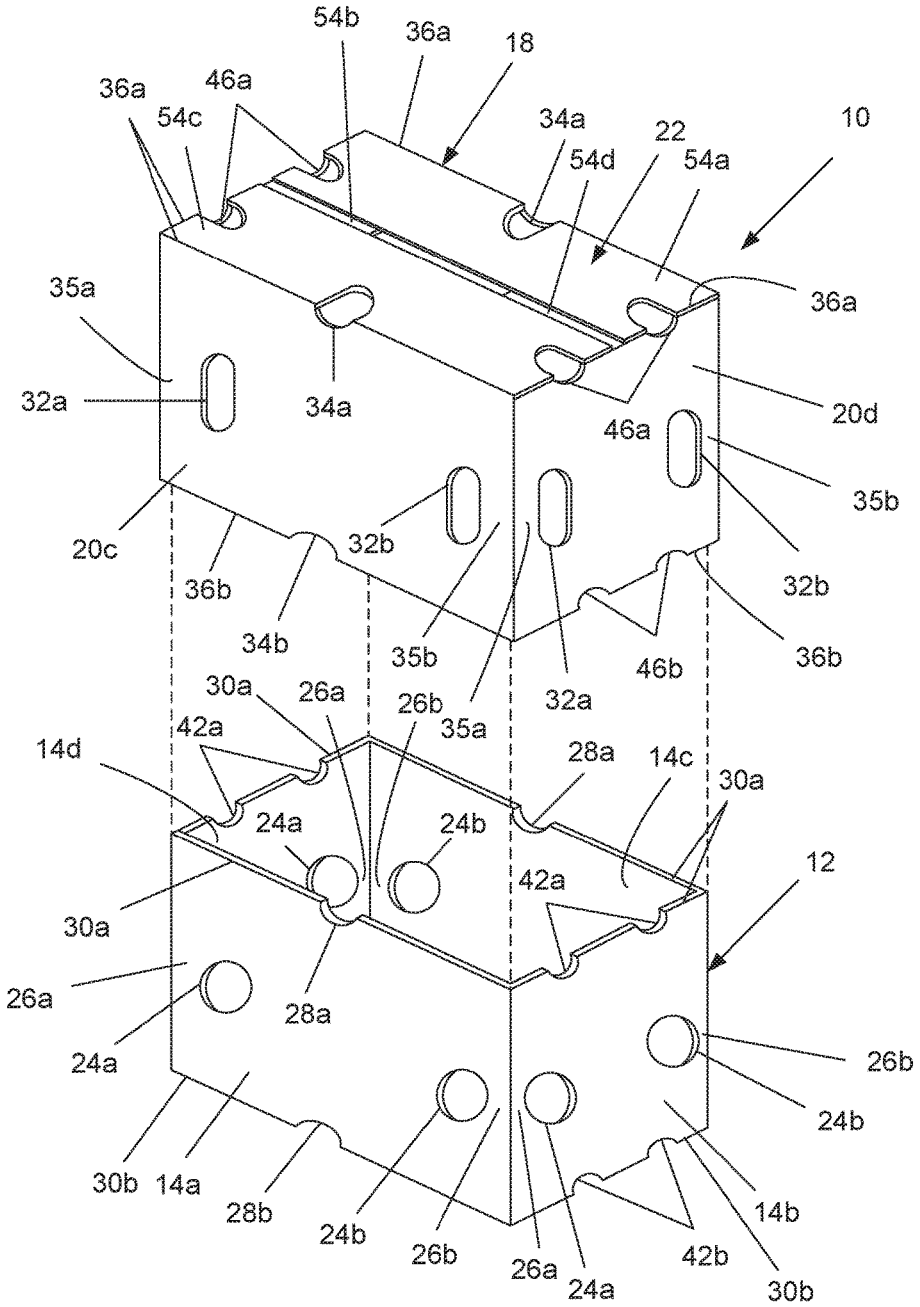
FIG. 4B is an exploded view of the box shown in FIG. 4*a;*

The produce box 10 show in FIGS. 4A to 6G is used to store produce, such as fruit and/or vegetables. A box 10 has been designed and optimised such that fast cooling of the produce is achieved with minimum loss of stacking strength to the box 10.

As particularly shown in FIGS. 6A to 6G, the box 10 includes a base 12, including:

(a) a series of side wall sections 14*a*, 14*b*, 14*c*, 14*d* coupled together to form a parallelogram;

(b) a bottom end section 16 coupled to the wall sections 14*a*, 14*b*, 14*c*, 14*d;*

(c) pairs of face vents 24*a*, 24*b* located in spaced apart lateral sections 26*a*, 26*b* of respective ones of the side wall sections 14*a*, 14*b*, 14*c*, 14*d*; and (d) pairs of major score vents 28*a*, 28*b* located centrally on respective top and bottom scores 30*a*, 30*b* of each side wall section of a first opposed pair 14*a*, 14*c* of the side wall sections.

As particularly shown in FIGS. 5A to 5G, the box 10 also includes a lid 18 which includes:

(a) a series of side wall sections 20*a*, 20*b*, 20*c*, 20*d* coupled together to form a parallelogram;

(b) a top end section 22 coupled to the wall sections 20*a*, 20*b*, 20*c*, 20*d;*

(c) pairs of face vents 32*a*, 32*b* located in spaced apart lateral sections 35*a*, 35*b* of respective ones of the side wall sections 20*a*, 20*b*, 20*c*, 20*d*; and (d) pairs of major score vents 34*a*, 34*b* located centrally on respective top and bottom scores 36*a*, 36*b* of each side wall section of a first opposed pair 20*a*, 20*c* of the side wall sections.

The pairs of face vents 24*a*, 24*b* of the base 12 at least partially overlap with corresponding pairs of face vents 32*a*, 23*b* of the lid 18 so that air can flow therethrough. Further, pairs of major score vents 28*a*, 28*c* of the base 12 at least partially overlap with major score vents 34*a*, 34*b* of the lid 18 so that air can flow therethrough.

Base 12

The base 12 includes two pairs of spaced apart minor score vents 42*a*, 42*b* respectively located on top and bottom scores 30*a*, 30*b* of each side wall section of a second opposed pair of side wall sections 14*b*, 14*d*. Further, the lid 18 includes two pairs of spaced apart minor score vents 46*a*, 46*b* respectively located on top and bottom scores 44*a*, 44*b* of each side wall section of a second opposed pair of side wall sections 14*b*, 14*d*.

In the example shown, the first opposed pair of the side wall sections 14*a*, 14*c* of the base 12 are longer than the second opposed pair of the side wall sections 14*b*, 14*d* of the base 12. Similarly, the first opposed pair of the side wall sections 20*a*, 20*c* of the lid 18 are longer than the second opposed pair of the side wall sections 20*b*, 20*d* of the lid 18. Alternatively, the box can be of any other suitable dimensions.

The pairs of minor score vents 42*a*, 42*b* of the base 12 at least partially overlap with corresponding pairs of minor score vents 46*a*, 46*b* of the lid 18 so that air can flow therethrough when the box 10 is assembled.

The face vents 24*a*, 24*b* of each pair of face vents are located in opposed side sections 26*a*, 26*b* of respective side wall sections of the base 12. Similarly, the face vents 32*a*, 32*b* of each pair of face vents are located in opposed side sections 35*a*, 35*b* of respective side wall sections of the lid 18. The face vents 24*a*, 24*b* of the base 12 and the face vents 32*a*, 32*b* of the lid 18 are all located close to corners of the box 10. Further, the pairs of face vents 24*a*, 24*b* of the base 12 are located centrally between the top and bottom scores 30*a*, 30*b*, and the pairs of face vents 32*a*, 32*b* of the lid 18 are located centrally between the top and bottom scores 36*a*, 36*b*.

Figure 6A:
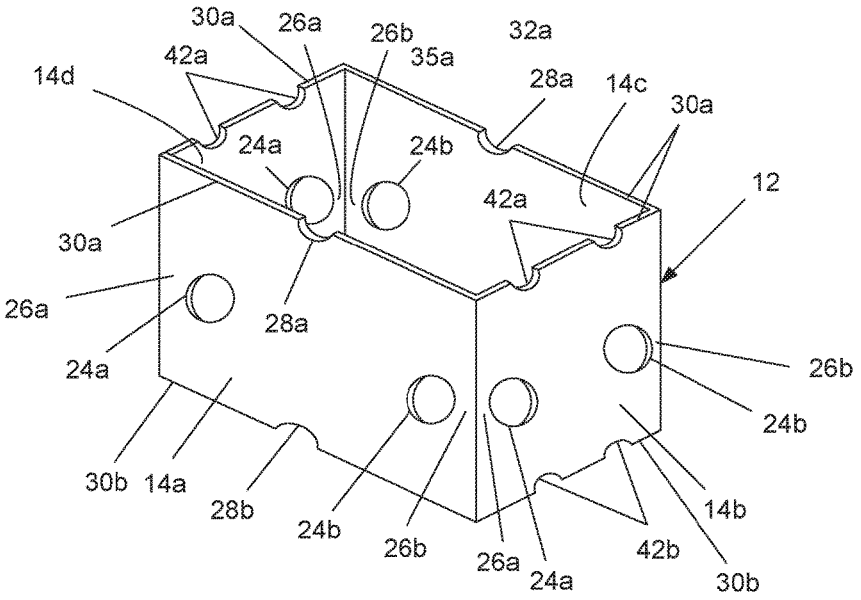
FIG. 6A is a top perspective view of a base of the box shown in FIG. 5A.
Figure 6B:
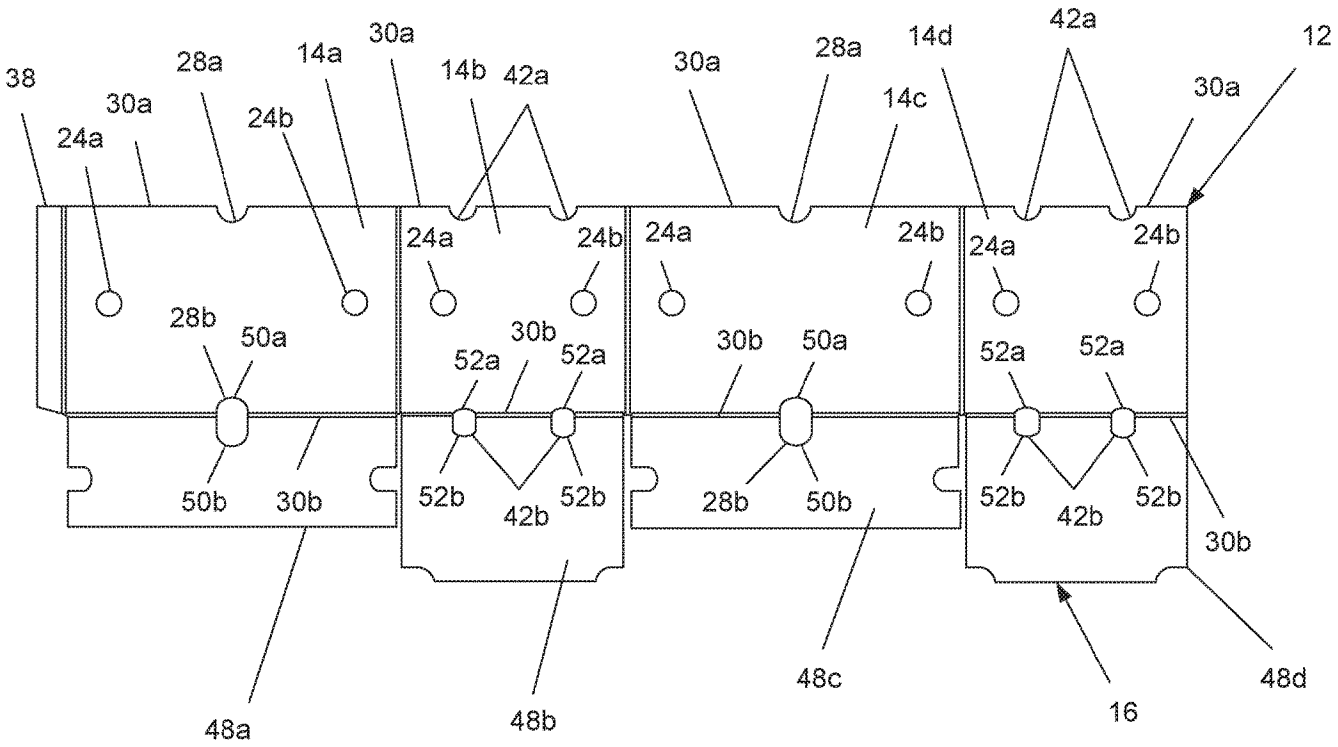
FIG. 6B is a plan view of a blank for the base of the box show in FIG. 6A.
Figure 6C:
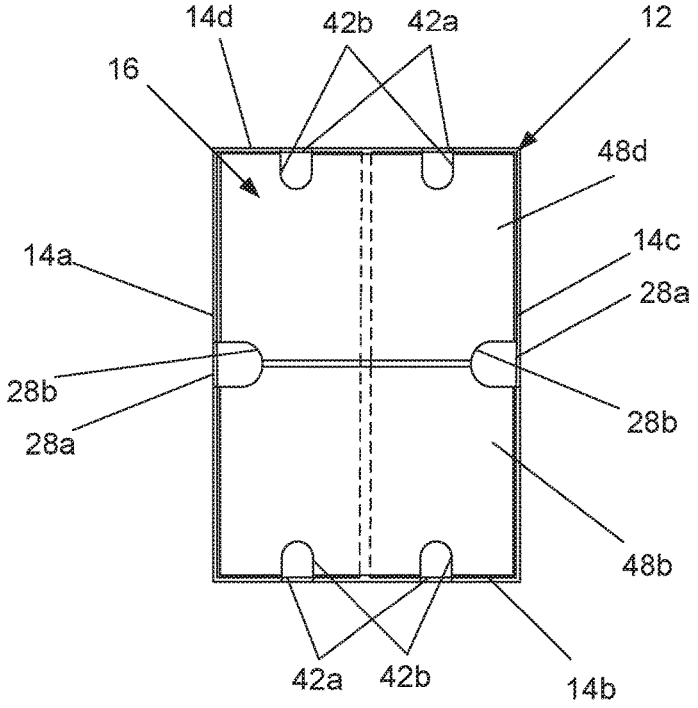
FIGS. 6C and 6D are top and bottom views of the base of the box shown in FIG. 6A.
Figure 6D:
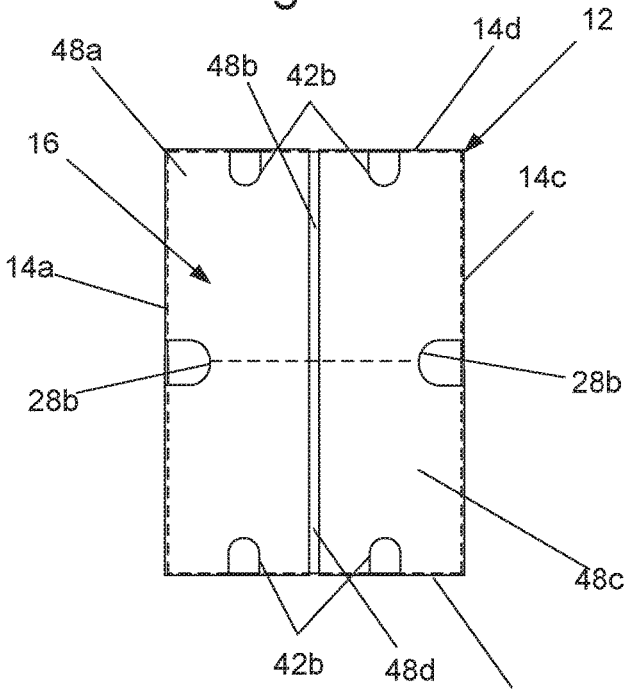
Figure 6E:
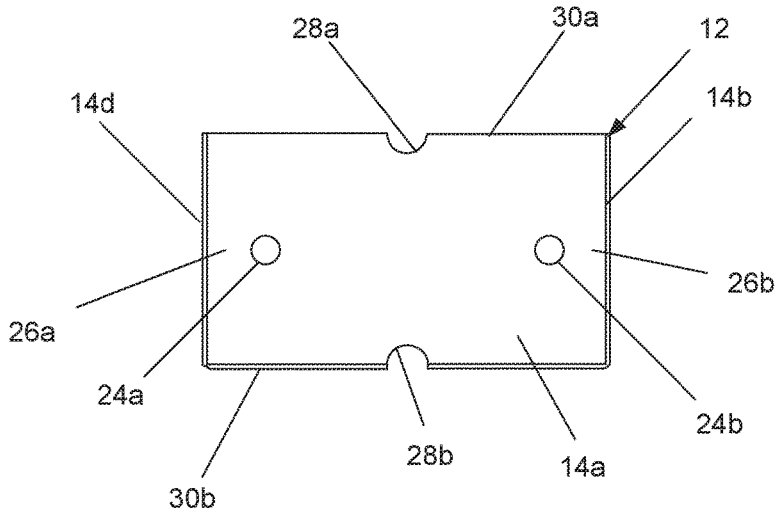
FIGS. 6E and 6F are side and end views of the base of the box shown in FIG. 6A.
Figure 6F:
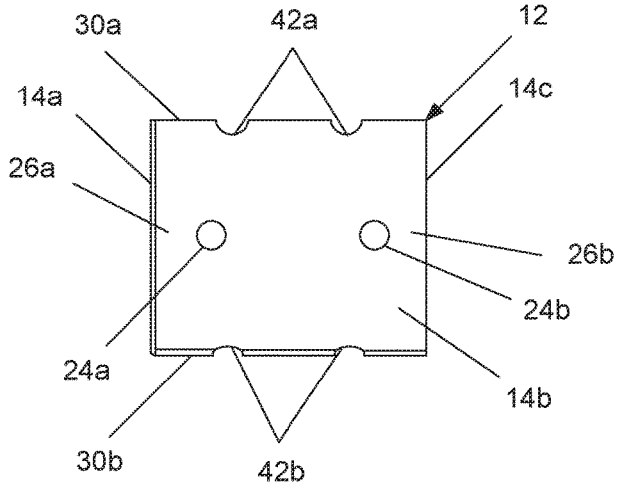

As particularly shown in FIGS. 6C and 6D, the bottom end section 16 of the base 12 is defined by overlapping flaps 48*a*, 48*b*, 48*c*, 48*d* coupled to and extending from bottom scores 30*b* of respective side wall sections.

Figure 6G:
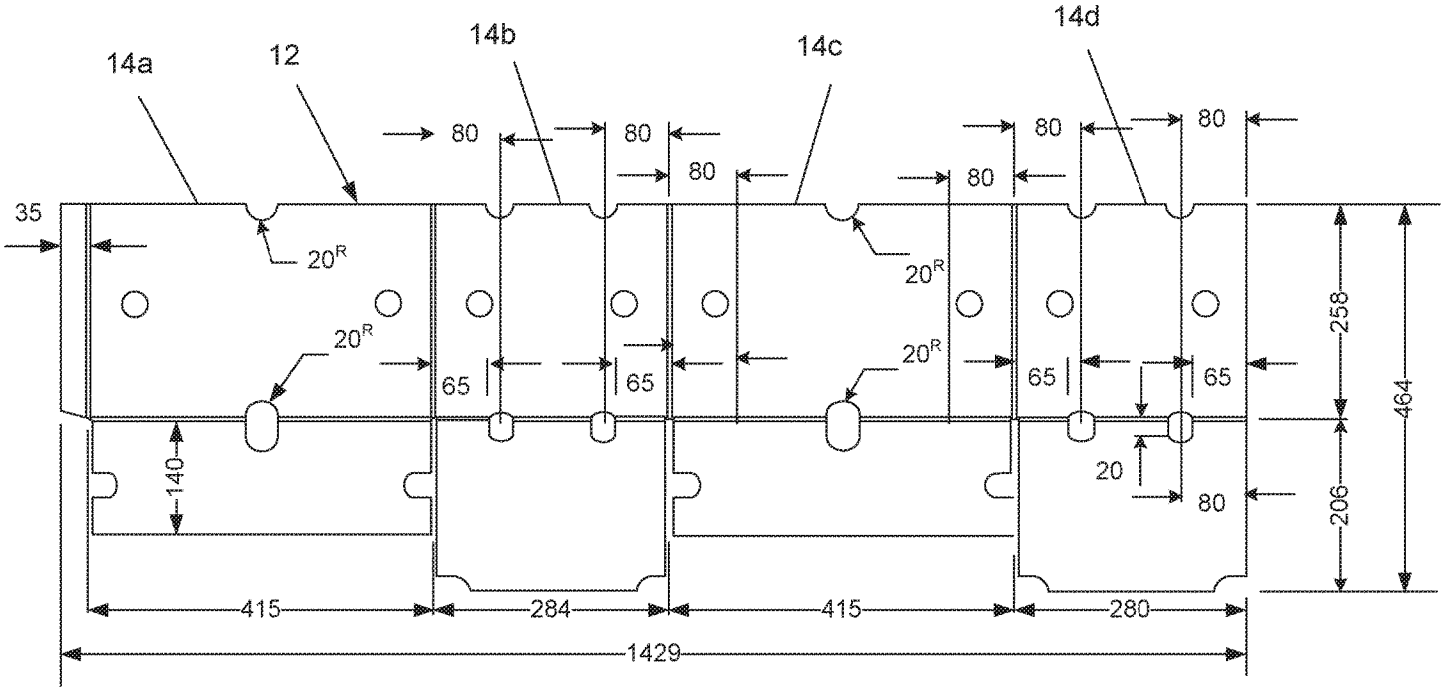
FIG. 6G is a plan view of a blank for the base of the box show in FIG. 6A.

As particularly shown in FIGS. 6B and 6G, the major score vents 28*b* located in the bottom scores 30*b* of the base 12 are at least partially defined by the overlapping flaps 48*a*, 48*c* coupled thereto. These major score vents 28*b* are each formed in two semicircular parts 50*a*, 50*b*. A first part 50*a* being located on a one of the side wall sections 14*a*, 14*b* and a second part 50*b* being located on a corresponding one of the flaps 48*a*, 48*b*. For each one of these major score vents 28*b*, the second part 50*b* is larger than the first part 50*a*. For each one of the major score vents 28*b*, the second part 50*b* is generally "U" shaped.

As also shown in FIGS. 6B and 6G, pairs of minor score vents 42*b* located in the bottom scores 30*b* of the base 12 are at least partially defined by the overlapping flaps 48*b*, 48*d* coupled thereto. Each minor score vent 42*b* is formed in two semicircular parts 52*a*, 52*b*. A first part 52*a* being located on a respective one of the side wall sections 14*b*, 14*c* and a second part 52*b* being located on a respective one of the flaps 48*b*, 48*d*. For each one of the minor score vents 42*b*, the second part 52*b* is larger than the first part 52*a*. For each one of the minor score vents 42*b*, the second part 52*b* is generally "U" shaped.

The major score vents 28*a*, 28*b* are larger than the minor score vents 42*a*, 42*b*.

Lid 18

The top end section 22 of the lid 18 is defined by overlapping flaps 54*a*, 54*b*, 54*c*, 54*d* coupled to and extending from top scores 36*a* of respective side wall sections 20*a*, 20*b*, 20*c*, 20*d*. The major score vents 34*a* located in the top scores 36*a* of the lid 18 are at least partially defined by the overlapping flaps 54*a*, 54*c* coupled thereto. These major score vents 34*a* are each formed in two semicircular parts 56*a*, 56*b*. A first part 56*a* being located on a respective one of the side wall sections 20*a*, 20*c* and a second part 56*b* being located on a respective one of the flaps 54*a*, 54*b*. For each one of the major score vents 34*a*, the second part 56*b* is larger than the first part 56*a*. Further, for each one of the major score vents 34*a* located in the top scores 36*a* of the lid 18, the second part is generally "U" shaped.

Figure 5A:
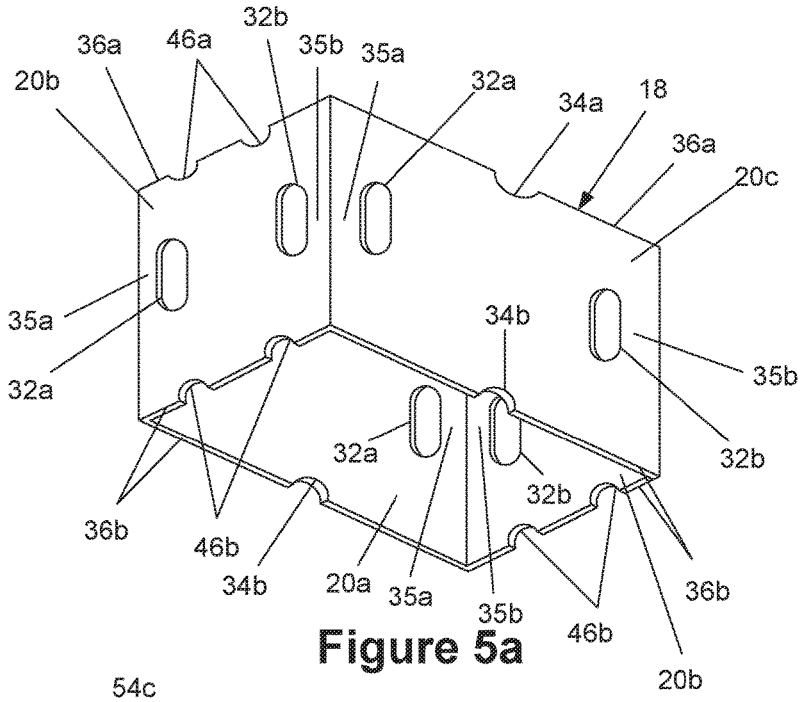
FIGS. 5A and 5B are bottom and top perspective views of a lid of the box shown in FIG. 4A.
Figure 5B:
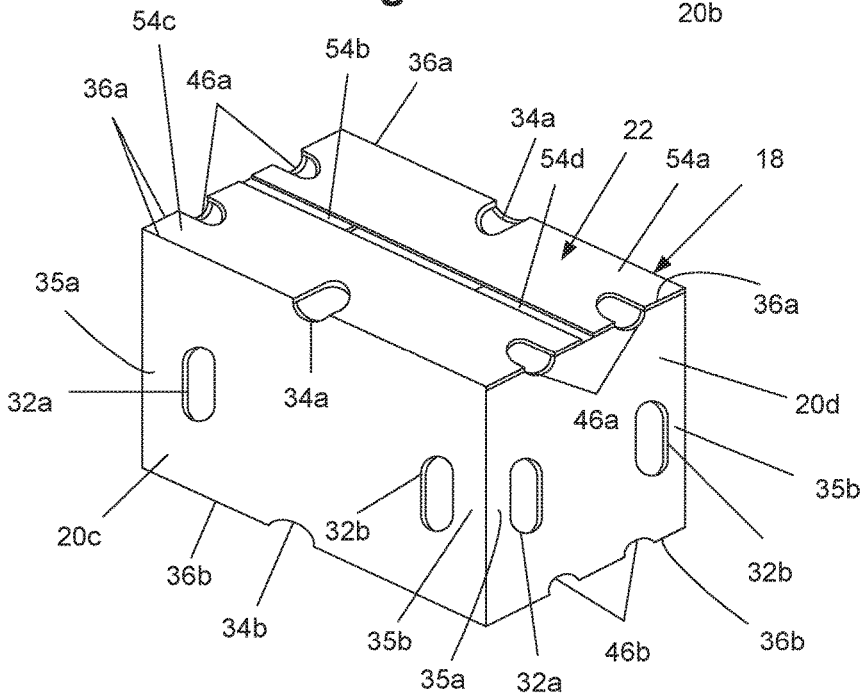
Figure 5C:
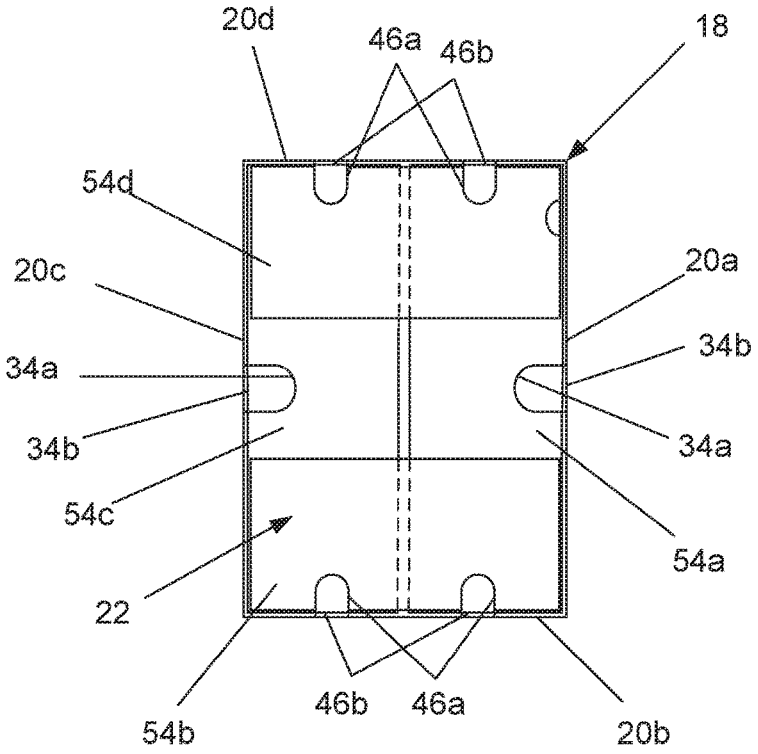
FIGS. 5C and 5D are bottom and top views of the lid of the box shown in FIG. 5A.
Figure 5D:
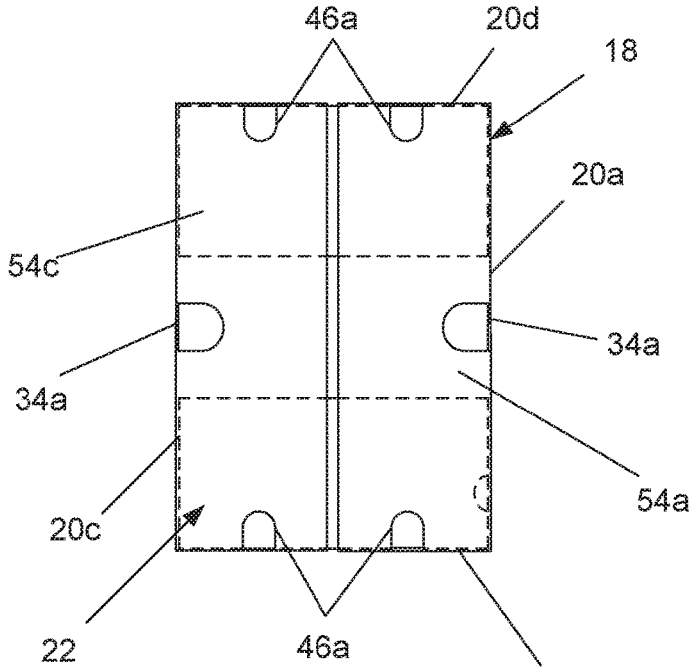
Figure 5E:
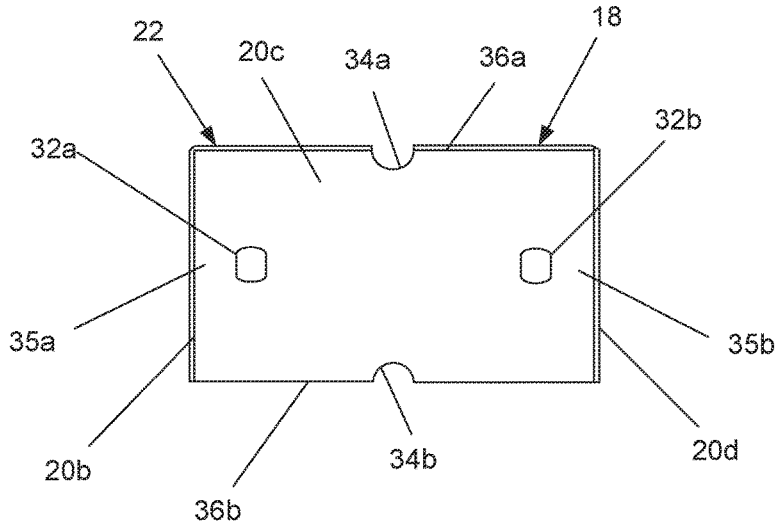
FIGS. 5E and 5F are side and end views of the lid of the box shown in FIG. 5A.
Figure 5F:
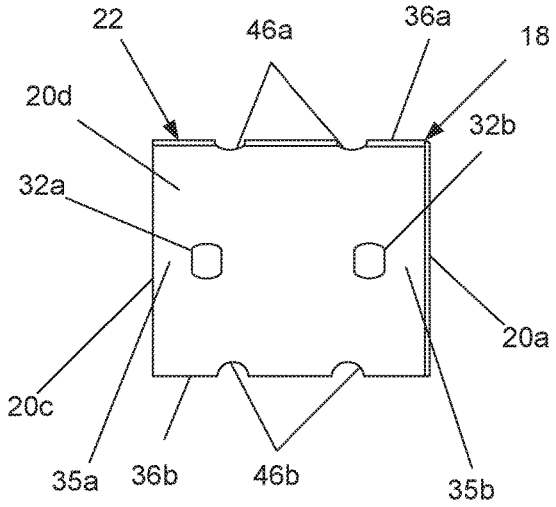
Figure 5G:
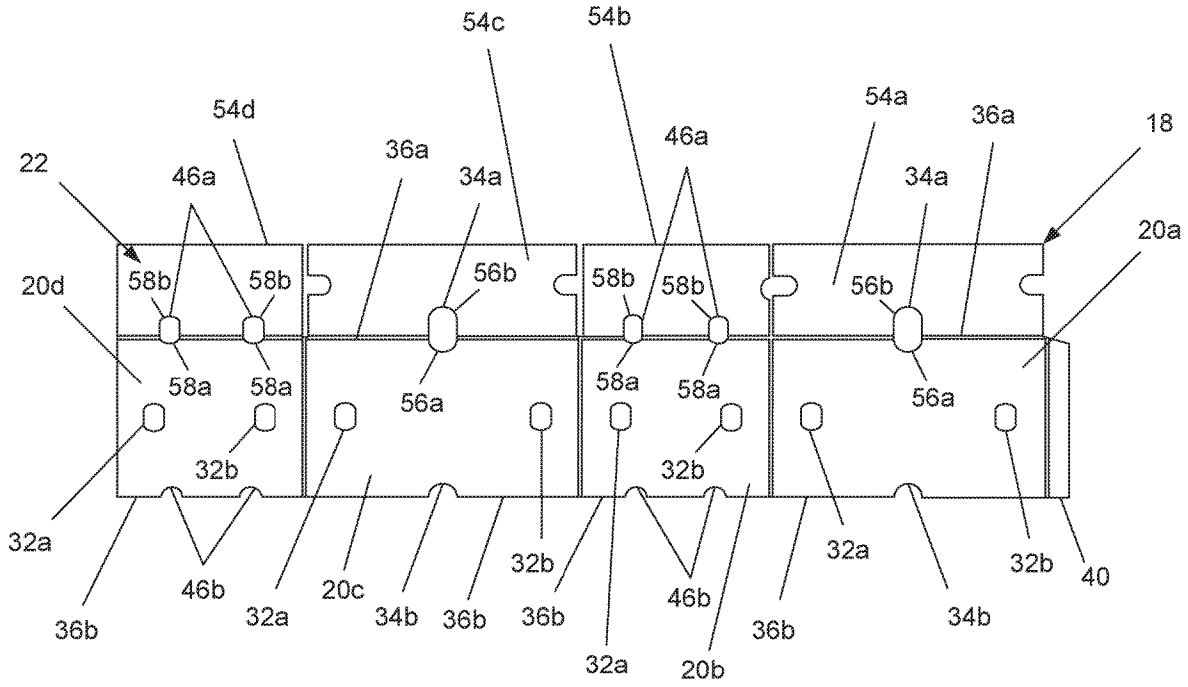
FIGS. 5G and 5H are plan views of a blank for the lid of the box show in FIG. 5A.
Figure 5H:
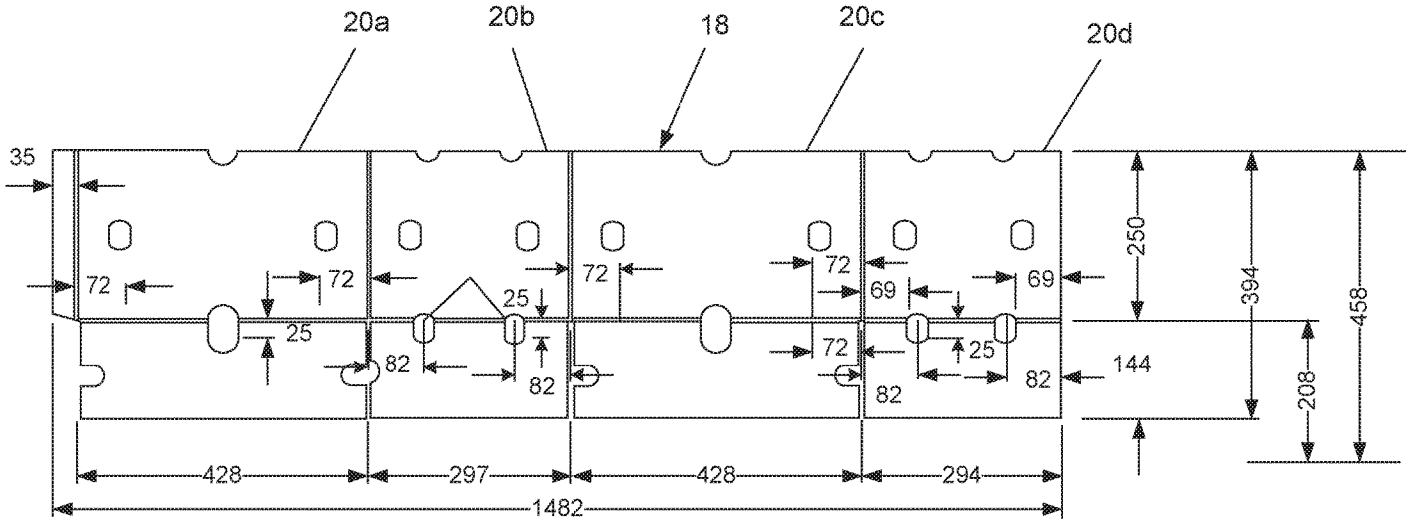

As particularly shown in FIGS. 5G and 5H, pairs of minor score vents 46*a* located in the top scores 36*a* of the lid 18 are at least partially defined by the overlapping flaps 54*b*, 54*d* coupled thereto. Each minor score vent of the pairs of minor score vents 46*a* is formed in two semicircular parts 58*a*, 58*b*. A first part 58*a* being located on a respective one of the side wall sections 20*b*, 20*d* and a second part 58*b* being located on a respective one of the flaps 54*b*, 54*d*. For each one of the minor score vents 46*a*, the second part 58*b* is larger than the first part 58*a*. Further, the second parts are generally "U" shaped.

The major score vents 34*a*, 34*b* are larger than the minor score vents 46*a*, 46*b*.

The series of side wall sections 14*a*, 14*b*, 14*c*, 14*d* of the base 12 preferably includes four side wall sections and a coupling flap 38, the coupling flap being coupled between first and fourth a wall sections 14*a*, 14*d* of the series of wall sections by a fastener, such as an adhesive. Similarly, the series of side wall sections of the lid 18 preferably includes four side wall sections and a coupling flap 40, the coupling flap 40 being coupled between first and fourth wall sections 22*a*, 22*d* of the series of wall sections by a fastener, such as an adhesive.

The face vents 24*a*, 24*b* of the base 12 are preferably circular in shape. Whereas the face vents 32*a*, 32*b* of the lid 18 are preferably elongate circles or ovals. Consequently, the box 10 can be overfilled with produce, resulting in a partial vertical separation of the lid 18 and the base 12, and corresponding face vents of the lid 18 and the base 12 will still overlap.

The face vents 24*a*, 24*b*, 32*a*, 32*b*, the major score vents 28*a*, 28*b*, 34*a*, 34*b*, and the pairs of minor score vents 42*a*, 42*b*, 46*a*, 46*b* of the box 10 interconnect with corresponding vents of neighbouring boxes in a pallet allowing air to flow vertically and horizontally through a pallet of the boxes 10. The boxes 10 can be arranged in the pallet with abutting long sides, and/or abutting short ends. In either one of these configurations, the face vents 24*a*, 24*b*, 32*a*, 32*b* of the boxes are interconnected. The boxes 10 can also be arranged in the pallet with abutting short and long ends. In this arrangement, at least one face vent 24*a*, 24*b*, 32*a*, 32*b* of the two abutting boxes are interconnected.

The major score vents 28*a*, 28*b*, 34*a*, 34*b* and the pairs of minor score vents 42*a*, 42*b*, 46*a*, 46*b* of the lid 18 and the base 12 are optimised for static cooling applications where natural convection currents provide cooling. The major and the minor score vents 28*a*, 28*b*, 34*a*, 34*b*, 42*a*, 42*b*, 46*a*, 46*b* of the lid 18 the base 12 provide channels where air can freely flow through a column of stacked boxes and increase cooling rates. The major score vents 28*a*, 28*b*, 34*a*, 34*b* allow for vertical air flow between palletised boxes allowing warm air to leave through a top layer of the pallet and cool air to enter a bottom layer of the pallet.

Experimenting with different vent patterns was carried out. The process involved iterating towards a pattern which gives the least stacking strength loss without upgrading to stronger paper grades. Comparison data for the box 10 against the box shown in FIGS. 1 to 3*c* are shown in Table 1 below.

Some box designs have interlocking vents for improved air flow when palletised. The interlocking vents of the box 10 prevent decreasing cooling performance when palletised.

The lid 18 is slightly wider and longer than the base 12, hence allowing the base 12 to slide into the lid 18 for assembly.

The vents have been optimised for air cross flow and fast cooling in forced-air cooling applications. Cooling was optimised through experiments for a single box 10. This vent pattern has low impact on the stacking strength of the box 10 by locating the face vents close to the corners of the box (ordinarily not done in box design) and having one large vent in the centre of the top and bottom scores on the long sides of the box. Stacking strength loss has been confirmed through box compression testing.

The size and number of vents on the sides, top and bottom of the box 10, which translates into percentage open vent area of the box, was designed to minimise the impact of the vents on stacking strength of the box. The percentage open vent area is less than typical industry practice would employ, however the paper strength does not require upgrading to compensate for strength loss associated with inserting holes in the sides, top and bottom of a box 10. That is, the box 10 performs to an acceptable level when vents are introduced compared to one where no vents are present.

Additional benefits can be claimed due to improvement of temperature distribution within palletised boxes. A standard eight boxes per layer palletisation pattern can be upgraded to nine boxes per layer. The addition of one box in the central chimney of an eight boxes per layer palletisation pattern will increase palletisation efficiency.

The box 10 is preferably a regular slotted container (RCS) type box.

Many modifications will be apparent to those skilled in the art without departing from the scope of the present invention Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

TABLE 1

| Box Geometry | Box 10 | Prior Art 1 |
|---|---|---|
| Top/Bottom Panel Vent Area ($mm^2$) | 6,668 | 2,828 |
| Long Panel Vent Area ($mm^2$) | 2,670 | — |
| Short Panel Vent Area ($mm^2$) | 2,828 | — |
| Total Box Vent Area ($mm^2$) | 24,332 | 5,656 |
| Top/Bottom Panel Area ($mm^2$) | 117,860 | 117,860 |
| Long Panel Area ($mm^2$) | 107,070 | 107,070 |
| Short Panel Area ($mm^2$) | 73,272 | 73,272 |
| Total Box Surface Area ($mm^2$) | 596,404 | 596,404 |
| Top/Bottom Percentage Vent Area (%) | 5.7% | 2.4% |
| Long Panel Percentage Vent Area (%) | 2.5% | 0.0% |
| Short Panel Percentage Vent Area (%) | 3.9% | 0.0% |
| Total Box Percentage Vent Area (%) | 4.1% | 0.9% |

| Cooling Rates | New Design | Existing Design 1 |
|---|---|---|
| Static Half Cooling Time (hrs) | 3.4 | 5.6 |
| Forced-Air Half Cooling Time (hrs) | 1.5 | N/A, no side vents |

| Stacking Strength<br>High Humidity Box Compression Strength | New Design | Existing Design 1 |
|---|---|---|
| Test 1 (kN) | 1.49 | 1.58 |
| Box Moisture Content (%) | 17.2 | 15.6 |
| Test 2 (kN) | 1.46 | 1.81 |
| Box Moisture Content (%) | 14.4 | 12.8 |

LIST OF PARTS

Produce box 10
Base 12
Side wall section 14*a*, 14*b*, 14*b*, 14*c*
Bottom end section 16
Lid 18
Side wall section 20*a*, 20*b*, 20*c*, 20*d*
Top end section 22
Face vent 24*a*, 24*b*
Lateral section 26*a*, 26*b*
Major score vent 28*a*, 28*b*
Top score 30*a*
Bottom score 30*b*
Face vent 32*a*, 32*b*
Major score vent 34*a*, 34*b*
Lateral section 35*a*, 35*b*
Top score 36*a*
Bottom score 36*b*
Coupling flap 38, 40
Minor score vent 42*a*, 42*b*
Minor score vent 46*a*, 46*b*
Flaps 48*a*, 48*b*, 48*c*, 48*d*
Semicircular part 50*a*, 50*b*, 52*a*, 52*b*
Flaps 54*a*, 54*b*, 54*c*, 54*d*
Semicircular part 56*a*, 56*b*, 58*a*, 58*b*

The invention claimed is:

1. A produce box for storing produce, including:

(a) a base, including:
- (i) a series of side wall sections coupled together to form a parallelogram;
- (ii) a bottom end section coupled to the side wall sections;
- (iii) pairs of face vents located in spaced apart lateral sections of each side wall section;
- (iv) pairs of major score vents located centrally on respective top and bottom scores of each side wall section of a first opposed pair of said side wall sections; and
- (v) two pairs of spaced apart minor score vents respectively located on top and bottom scores of each side wall section of a second opposed pair of said side wall sections; and (b) a lid, including:
- (i) a series of side wall sections coupled together to form a parallelogram;
- (ii) a top end section coupled to the side wall sections;
- (iii) pairs of face vents located in spaced apart lateral sections of each side wall section;
- (iv) pairs of major score vents located centrally on respective top and bottom scores of each side wall section of a first opposed pair of said side wall sections; and
- (v) two pairs of spaced apart minor score vents respectively located on top and bottom scores of each side wall section of a second opposed pair of said side wall sections, wherein the pairs of face vents of the base at least partially overlap with corresponding pairs of face vents of the lid so that air can flow therethrough, wherein the pairs of major score vents of the base at least partially overlap with the pairs of major score vents of the lid so that air can flow therethrough wherein the pairs of minor score vents of the base at least partially overlap with corresponding pairs of minor score vents of the lid so that air can flow therethrough, wherein the pairs of face vents of the base and the lid are located centrally between the top and bottom scores, and wherein the face vents of the base and the lid are located close to corners of the box.

2. The box claimed in claim 1, wherein the face vents of each pair of face vents are located in opposed side sections of respective side wall sections of the base, and the face vents of each pair of face vents are located in opposed side sections of respective side wall sections of the lid.

3. The box claimed in claim 1, wherein the bottom end section of the base is defined by overlapping flaps coupled to and extending from bottom scores of respective side wall sections and wherein said major score vents located in the bottom scores of the base are at least partially defined by said overlapping flaps coupled thereto.

4. The box claimed in claim 3, wherein said major score vents located in the bottom scores of the base are each formed in two semicircular parts, a first part of said parts being located on a respective one of said side wall sections and a second part of said parts being located on a respective one of said overlapping flaps.

5. The box claimed in claim 4, wherein for each one of said major score vents located in the bottom scores of the base, the second part is larger than the first part.

6. The box claimed in claim 3, wherein pairs of minor score vents located in the bottom scores of the base are at least partially defined by said overlapping flaps coupled thereto.

7. The box claimed in claim 6, wherein each minor score vent of said pairs of minor score vents are each formed in two semicircular parts, a first part of said parts being located on a respective one of said side wall sections and a second part of said parts being located on a respective one of said flaps.

8. The box claimed in claim 7, wherein for each one of said minor score vents located in the bottom scores of the base, the second part is larger than the first part.

9. The box claimed in claim 1, wherein the top end section of the lid is defined by overlapping flaps coupled to and extending from top scores of respective side wall sections.

10. The box claimed in claim 9, wherein said major score vents located in the top scores of the lid are at least partially defined by said overlapping flaps coupled thereto.

11. The box claimed in claim 10, wherein said major score vents located in the top scores of the lid are each formed in two semicircular parts, a first part of said parts being located on a respective one of said side wall sections and a second part of said parts being located on a respective one of said flaps.

12. The box claimed in claim 11, wherein for each one of said major score vents located in the top scores of the lid, the second part is larger than the first part.

13. The box claimed in claim 9, wherein pairs of minor score vents located in the top scores of the lid are at least partially defined by said overlapping flaps coupled thereto.

14. The box claimed in claim 13, wherein each minor score vent of said pairs of minor score vents are each formed in two semicircular parts, a first part of said parts being located on a respective one of said side wall sections and a second part of said parts being located on a respective one of said flaps.

15. The box claimed in claim 14, wherein for each one of said minor score vents located in the top scores of the lid, the second part is larger than the first part.

16. The box claimed in claim 1, wherein the face vents, the major score vents, and the minor score vents can interconnect with corresponding vents of neighbouring boxes in a pallet allowing air to flow horizontally through a palletized layer.

17. The box claimed in claim 1, wherein the major score vents and the minor score vents in the top and bottom scores of the lid and the base have been optimized for static cooling applications where natural convection currents provide cooling.

18. The box claimed in claim 17, wherein the major and the minor score vents in the top and bottom scores of the lid and the base provide channels where air can freely flow through a column of stacked boxes and increase cooling rates.

19. The box claimed in claim 1, wherein the major score vents allow for vertical air flow between palletized boxes allowing warm air to leave through a top layer of the pallet and cool air to enter a bottom layer of the pallet.

20. A blank for the lid of the produce box claimed in claim 1.

21. A base of a produce box for storing produce, including:

(a) a series of side wall sections coupled together to form a parallelogram;

(b) a bottom end section coupled to the side wall sections;

(c) pairs of face vents located in spaced apart lateral sections of each side wall section;

(d) pairs of major score vents located centrally on respective top and bottom scores of each side wall section of a first opposed pair of said side wall sections;

(e) two pairs of spaced apart minor score vents respectively located on top and bottom scores of each side wall section of a second opposed pair of said side wall sections, wherein the pairs of minor score vents of the base at least partially overlap with corresponding pairs of minor score vents of a base of a neighboring produce box so that air can flow between the produce box and the neighboring produce box, wherein the pairs of face vents of the base are located centrally between the top and bottom scores, and wherein the face vents of the base are located close to corners of the box.

22. The base claimed in claim 21, wherein the bottom end section of the base is defined by overlapping flaps coupled to and extending from bottom scores of respective side wall sections.

23. The base claimed in claim 22, wherein said major score vents located in the bottom scores of the base are at least partially defined by said overlapping flaps coupled thereto.

24. The base claimed in claim 23, wherein said major score vents located in the bottom scores of the base are each formed in two semicircular parts, a first part of said parts being located on a respective one of said side wall sections and a second part of said parts being located on a respective one of said flaps.

25. The base claimed in claim 24, wherein for each one of said major score vents located in the bottom scores of the base, the second part is larger than the first part.

26. The base claimed in claim 22, wherein pairs of minor score vents located in the bottom scores of the base are at least partially defined by said overlapping flaps coupled thereto.

27. The base claimed in claim 26, wherein each minor score vent of said pairs of minor score vents are each formed in two semicircular parts, a first part of said parts being located on a respective one of said side wall sections and a second part of said parts being located on a respective one of said flaps.

28. The base claimed in claim 27, wherein for each one of said minor score vents located in the bottom scores of the base, the second part is larger than the first part.

29. A blank for the base of the produce box claimed in claim 21.

* * * * *